United States Patent [19]

Franke

[11] Patent Number: 4,842,914

[45] Date of Patent: Jun. 27, 1989

[54] EDGE PROTECTOR ANGLE PIECE

[75] Inventor: Heinz Franke, Übach-Palenberg, Fed. Rep. of Germany

[73] Assignee: Spanset Inter AG, Oetwil am See, Switzerland

[21] Appl. No.: 194,251

[22] Filed: May 16, 1988

[30] Foreign Application Priority Data

May 16, 1987 [DE] Fed. Rep. of Germany ... 8707080[U]

[51] Int. Cl.[4] ..... B65D 81/08

[52] U.S. Cl. ..... 428/99; 428/192; 217/69; 206/453; 206/586

[58] Field of Search ..... 428/99, 192; 206/586, 206/453; 217/69; 248/345.1; 294/74

[56] References Cited

U.S. PATENT DOCUMENTS

| | | | |
|---|---|---|---|
| 1,402,330 | 1/1922 | Whiteley | 206/14 |
| 1,469,857 | 10/1923 | Treat | 217/69 |
| 2,004,626 | 6/1935 | Hann | 206/60 |
| 2,793,904 | 5/1957 | Gale | 294/74 |

FOREIGN PATENT DOCUMENTS

| | | | |
|---|---|---|---|
| 2050187 | 4/1972 | Fed. Rep. of Germany | 206/50 |
| 2617268 | 10/1977 | Fed. Rep. of Germany | 280/15 |
| 1250207 | 11/1960 | France | 294/6 |
| 19371 | of 1911 | United Kingdom | 260/14 |

*Primary Examiner*—Alexander S. Thomas
*Attorney, Agent, or Firm*—Spencer & Frank

[57] ABSTRACT

An edge protector angle piece for a load to be lifted by a lifting device includes first and second angle arms having inner faces for contacting the load and outer faces together forming a continuous cylinder surface of essentially ring-segment shape, having a continuous guide groove therein for accommodating the lifting device. A vertex region is provided between the angle arms. A guide tube is provided on the outer faces at the vertex region in alignment with the guide groove for further accommodating the lifting device.

12 Claims, 2 Drawing Sheets

EDGE PROTECTOR ANGLE PIECE

BACKGROUND OF THE INVENTION

The present invention relates to an edge protector angle piece for insertion between a load to be lifted and a lifting device, such as a chain or a wire cable. The angle piece has two angle arms which, with their respective preferably mutually perpendicular inner faces engage the load. The outer faces of the angle arms form together a continuous cylindrical surface, describing a ring segment in which a groove is formed which is coextensive with the ring segment and which serves to receive the lifting device.

Such angle pieces, disclosed, for example, in British Pat. No. 19,371 to Turner, are used to protect the load to be lifted, having delicate surfaces or edges, against damage by the action of the lifting device. To achieve such protection, the interior faces of the two arms of the angle piece engage the load to be lifted. Due to the surface contact of the two angle arms, the pressure of the lifting device is distributed over a greater area and thus the surfaces or edges of the load are protected. Such angular edge protectors are required particularly when the lifting device is a chain or wire cable which has only point contact or linear contact regions with the load and therefore surface pressures at these regions are very high. This is avoided by use of an edge protector angle piece.

A guide groove extending on the outer faces of the two angle arms in their longitudinal direction prevents the lifting device from slipping off the edge protector.

It is a disadvantage of the known edge protector angle piece disclosed in the above British patent that the inner faces of the two angle arms which contact the load, each have only a web-like configuration so that the load is stressed to a relatively great extent at these essentially linear contact faces. This effect is further augmented by the use of hard materials for the edge protector such as wood, iron, brass or aluminum. Moreover, the guide groove does not have positive guiding properties and thus the edge protector can easily shift on the lifting device. The protective effect of such edge protectors and their reliability is thus a major concern.

SUMMARY OF THE INVENTION

It is an object of the present invention to provide an improved edge protector angle piece of the above-outlined type which, particularly when used with a chain, a wire cable or the like, constitutes a lifting device which offers a high degree of protection for the load being lifted and offers reliability when in use.

This object and others to become apparent as the specification progresses, are accomplished by the invention, according to which, briefly stated, the edge protector angle piece for protecting an edge of a load to be lifted by a lifting device has first and second angle arms having inner faces for contacting the load and outer faces forming a ring segment-like (ring segment-shaped) continuous cylinder surface including a vertex region between the angle arms; a continuous guide groove provided in the cylinder surface for accommodating the lifting device; and a guide tube provided on the outer faces at the vertex region in alignment with the guide groove for receiving the lifting device.

By configuring the edge protector angle piece as a block composed of a tough-elastic solid plastic material, its manufacture by, for example casting, is particularly easy. The edge protector is extremely stable and is particularly suitable for use with a chain as the lifting device when lifting heavy loads. The full-surface inner faces of the angle arms permit optimum distribution of the pressure acting on the load during the lifting process. By proper selection of the tough-elastic material, damage to the load is reliably avoided and safety is increased considerably. The tough-elastic material may be, for example, polyurethane. These effects are further reinforced by providing the guide tube on the outer cylinder face in the vertex region of the angle arms, while at the same time, producing a constant and durable connection between the lifting device and the edge protector. This connection reliably prevents a loss of the edge protector, while allowing a longitudinal displacement of the edge protector on the lifting device to adapt it to loads of various sizes.

The metal guide tube additionally prevents tilting of the edge protector angle piece transversely to the direction of passage of the lifting device. This further improves the guide characteristics of the angle piece. Moreover, the guide tube is particularly resistant to the forces acting on the chain, wire cable or the like due to the pull during lifting.

This effect is further enhanced by curving the metal tube to correspond to the curvature of the outer cylinder face. Also, the smooth transition of the guide groove into the inner wall of the guide tube produces no edges or steps which could form a point-like contact surface for the lifting device. Such steps would interfere with the free displacement of the edge protector angle piece on the lifting device and would hamper its adaptation to the dimensions of a load to be lifted.

The manner of fastening the metal tube to the edge protector angle piece is particularly robust, yet very easy to manufacture. A mounting plate, in the form of a perforated metal sheet, is cast into the block of the edge protector angle piece. These perforations are filled by the material of the block in a form locking manner so that the metal tube and the edge protector angle piece are permanently anchored together.

According to a further feature of the invention the guide tube is provided on its outer side with an insertion slot to make it possible to place the edge protector angle piece by lateral insertion onto a closed-loop lifting device. Depending on the requirements, this permits flexible use with different lifting devices, such as an endless chain, wire cable loop or the like, which can be introduced through the insertion slot into the guide tube.

Particularly advantageous from a safety point of view is the use of a guide slot having a predetermined width such that only lifting devices having a sufficient carrying capability, which is a function of their diameter, can be introduced into the tube. The carrying capability is adapted to the stability of the edge protector angle piece. This arrangement, in conjunction with the edge protector prevents a lifting device from lifting too heavy a load which could destroy the edge protector angle piece and cause the lifting device to damage the load.

According to a further feature of the invention, projections are provided on the lateral edges of the slot of the guide tube which extend into the slot opening to permit only chains having predetermined link dimensions and a corresponding load carrying capability to be inserted into the tube. The projections make it impossible to insert a chain which has a spacing that is too small or too large between two adjacent links of a connecting link. This selection is adapted to a "3-d pitch" of a chain, that is, the length dimension of the eye of a chain link corresponds to three times the thickness of the wire of which a chain link is made.

DESCRIPTION OF THE PREFERRED EMBODIMENT

Figure 1:
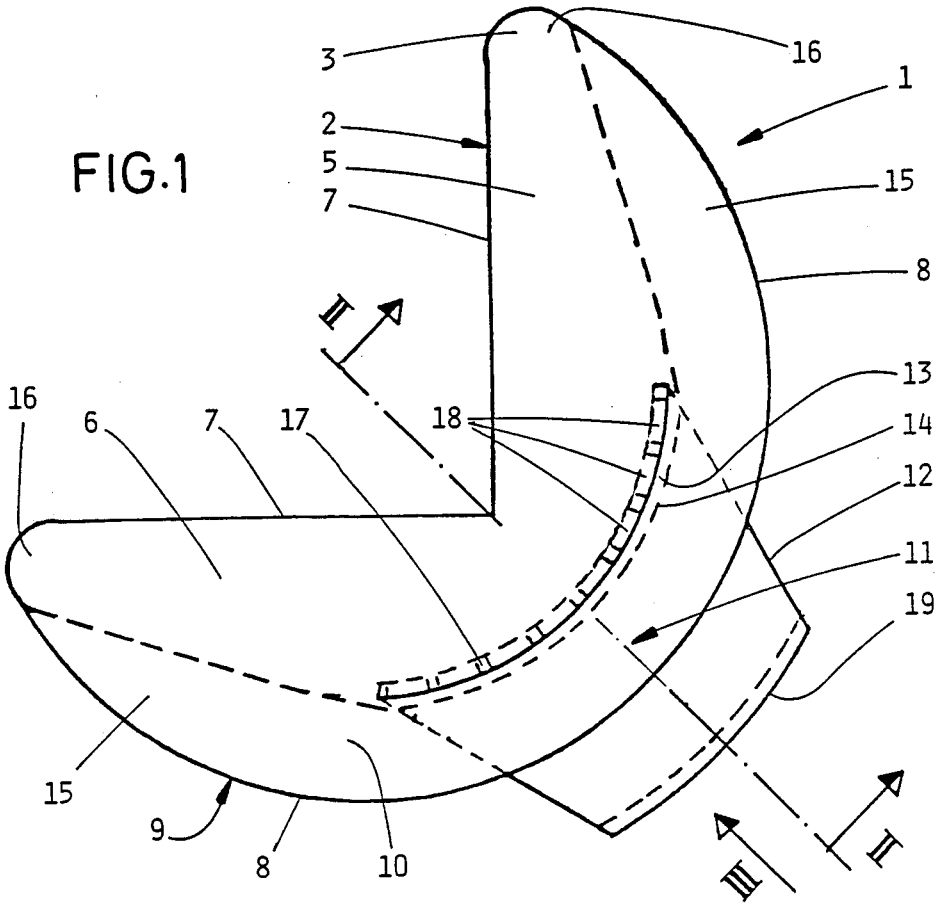
FIG. 1 is a side elevational view of an edge protector angle piece according to a preferred embodiment of the invention.

Turning now to FIG. 1, the edge protector angle piece 1 shown therein includes a block 2 which is made of a toughelastic solid plastic material and which has mutually parallel top and bottom faces 3 and 4. Interior faces 7 of two angle arms 5 and 6, which are oriented at right angles to one another, contact the two surfaces of an edge zone of a load (not shown) to be lifted.

Outer faces 8 of the angle arms 5 and 6 together form a continuous cylindrical surface 9 describing essentially a ring segment in which a guide groove 10 having an arcuate cross section is formed. The guide groove 10 extends in the circumferential direction of the ring segment. When the load is lifted, a chain or a wire cable not shown in FIG. 1) is received in the guide groove 10 such that the edge protector angle piece is placed between the cable and the load. At its ends, the outer cylinder face 9 joins the respective inner planar faces 7 with a rounded connecting portion 16.

A guide tube 12 is fastened to the exterior of the cylinder face 9, in a vertex region 11 of angle arms 5 and 6, with a chain being insertable therethrough. The guide tube 12, made of metal, such as steel or aluminum, extends over part of the circumferential length of cylinder face 9 and is centered at the midpoint of the circumferential length, and is curved to correspond to the curvature of the cylinder face 9. Due to an inclined cut-off of the ends of the tube 12, the region 13 of the tube wall which is fastened to the cylinder face 9 is longer than the region 19 on the exterior.

The cross-sectionally arcuate guide groove 10 has a smooth transition into the interior wall face 14 of guide tube 12.

The bottom of guide groove 10, which extends to both sides outside of guide tube 12, is linear in the longitudinal direction of the angle arms 5 and 6 so that the lateral wall portions 15 formed by the guide groove 10 diminish in height as the distance from vertex region 11 increases until the guide groove 10 vanishes at the free ends 16 of angle arms 5 and 6.

The guide tube 12 is fixed to block 2 by means of a mounting plate 17. The mounting plate 17 is fastened to the entire length of the guide tube 12 in the region where wall 13 of the guide tube 12 lies against block 2. The mounting plate 17 is curved in the longitudinal direction to correspond to the curved course of the guide tube 12. The mounting plate 17 is perforated metal sheet, thus providing a particularly stable anchor for the guide tube 12 in the block 2 of the edge protector 1. The solid plastic material of block 2 fills the openings 18 in the perforated metal sheet 17 in a form-locking manner.

Figure 2:
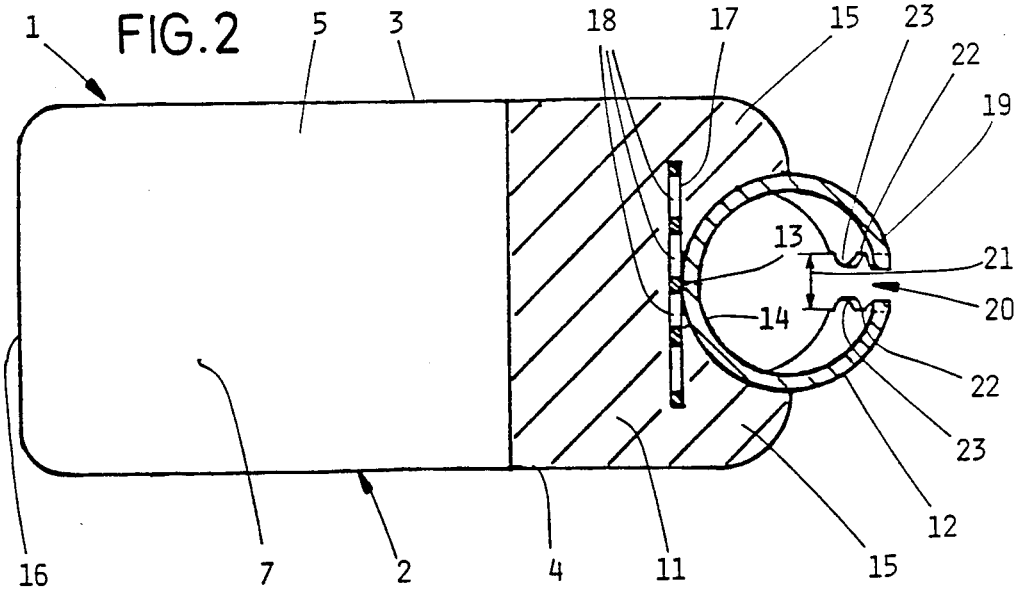
FIG. 2 is a sectional view along line II—II of FIG. 1.
Figure 3:
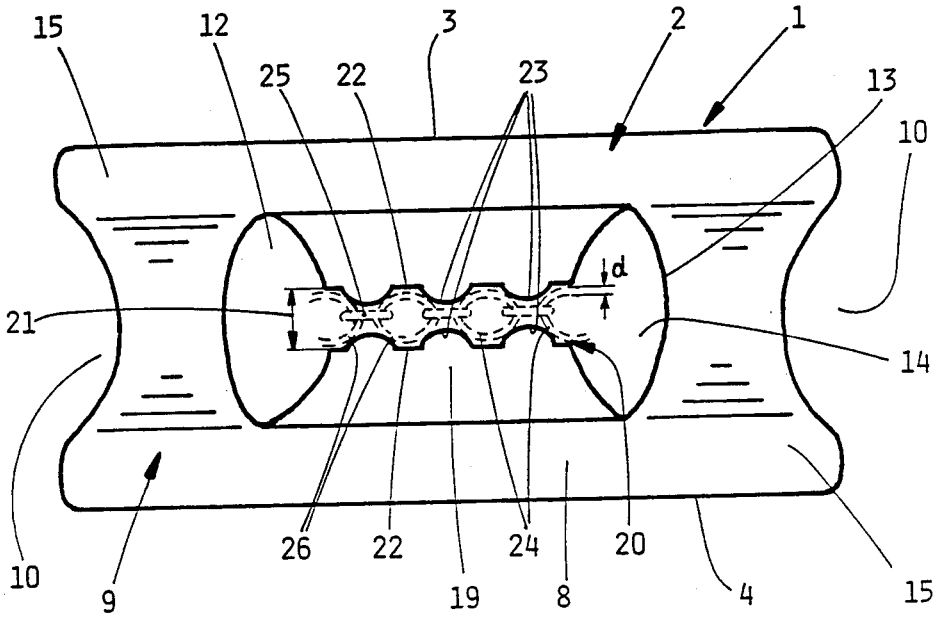
FIG. 3 is a rear elevational view seen in the direction of arrow III of FIG. 1.

As can be seen in FIGS. 2 and 3, the exterior 19 of guide tube 12 is provided with an insertion slot 20, parallel to the axis of the tube, for the insertion of a chain or wire cable. By providing the guide tube 12 with such an insertion slot 20, the edge protector angle piece 1 can be used with a closed loop or endless chain.

The width 21 of insertion slot 20 limits the maximum thickness of the chain or wire cable which may be used. Therefore, only lifting devices having a maximum load carrying capability, which is a function of their diameter, can be introduced into guide tube 12.

The edges 22 defining the slot 20 are provided with projections 23 which extend into the slot opening and, when viewed from the outside, as in FIG. 3, have an approximately semicircular configuration and are uniformly distributed along the edges 22. The arrangement of projections 23 is coordinated with the "3-d pitch" of the chain (shown in phantom lines) that is, the longitudinal dimension of the eye of a chain link 24 which corresponds to three times the thickness d of the link wire.

It is apparent from FIG. 3 that chains having smaller dimensions, because of their shorter spacing between two adjacent links 26 connected together by a connecting link 25, as well as chains having larger dimensions, where the spacing is larger than that desired, cannot be introduced into guide tube 12.

The present disclosure relates to the subject matter disclosed in Federal Republic of Germany Application No. G 87 07 080.4, filed May 16th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An edge protector angle piece for protecting an edge of a load to be lifted by a lifting device, comprising:

first and second angle arms having inner faces for contacting said load and outer faces forming a ring segmentshaped continuous cylinder surface including a vertex region between said angle arms;

a continuous guide groove provided in said cylinder surface for accommodating said lifting device; and a guide tube provided on said outer faces at said vertex region in alignment with said guide groove for receiving said lifting device.

2. An edge protector angle piece as defined in claim 1, wherein said lifting device is a chain.

3. An edge protector angle piece as defined in claim 1, wherein said angle arms and said vertex region form a single block made of a tough-elastic solid plastic material.

4. An edge protector angle piece as defined in claim 3, wherein the guide tube is fixed to a mounting plate which is curved longitudinally to approximately correspond to the curvature of said cylinder surface; said mounting plate being cast into said block.

5. An edge protector angle piece as defined in claim 4, wherein said mounting plate is a bent perforated metal sheet.

6. An edge protector angle piece as defined in claim 1, wherein said guide tube is made of metal.

7. An edge protector angle piece as defined in claim 1, wherein said guide tube extends over a portion of a circumferential length of said cylinder surface and is curved to correspond to the curvature of said cylinder surface.

8. An edge protector angle piece as defined in claim 1, wherein said guide groove has an arcuate cross section; said guide groove being substantially flush with an interior wall surface of said guide tube.

9. An edge protector angle piece as defined in claim 1, wherein said guide tube has a length dimension; further comprising an insertion slot allowing insertion of said lifting device therethrough, said insertion slot being provided in said guide tube and oriented parallel to said length dimension.

10. An edge protector angle piece as defined in claim 9, wherein a width of the insertion slot is dimensioned such that only lifting devices having a predetermined maximum diameter representing a carrying capability thereof can be inserted into said guide tube through the slot; said carrying capability being adapted to the stability of said edge protector angle piece.

11. An edge protector angle piece as defined in claim 9, wherein said lifting device is a chain, and lateral edges of said insertion slot are provided with projections extending into said slot such that only chains having certain link dimensions can be introduced through said insertion slot and into said guide tube.

12. An edge protector angle piece as defined in claim 1, wherein said inner faces of said angle arms are oriented perpendicularly to one another.

* * * * *